United States Patent [19]

Uchide et al.

[11] Patent Number: 4,868,084

[45] Date of Patent: Sep. 19, 1989

[54] DEVELOPER FOR DEVELOPING ELECTROSTATIC LATENT IMAGE AND IMAGE FORMING METHOD

[75] Inventors: Hitoshi Uchide, Kawasaki; Tetsuya Kuribayashi, Tokyo; Manabu Ohno, Yokohama, all of Japan

[73] Assignee: Canon Kabushiki Kaisha, Tokyo, Japan

[21] Appl. No.: 128,263

[22] Filed: Dec. 1, 1987

[30] Foreign Application Priority Data

| | | | |
|---|---|---|---|
| Dec. 1, 1986 | [JP] | Japan | 61-287171 |
| Dec. 1, 1986 | [JP] | Japan | 61-287172 |
| Dec. 1, 1986 | [JP] | Japan | 61-287173 |
| Dec. 1, 1986 | [JP] | Japan | 61-287174 |
| Dec. 1, 1986 | [JP] | Japan | 61-287175 |

[51] Int. Cl.[4] ..... G03G 9/08

[52] U.S. Cl. ..... 430/110; 430/115; 430/291

[58] Field of Search ..... 430/110, 115

[56] References Cited

U.S. PATENT DOCUMENTS

| | | | |
|---|---|---|---|
| 4,404,271 | 9/1983 | Kawagashi et al. | 430/110 |
| 4,563,409 | 1/1986 | Suzuki et al. | 430/110 X |
| 4,618,556 | 10/1986 | Takenouchi | 430/110 |
| 4,640,882 | 2/1987 | Mitsuhashi et al. | 430/110 |
| 4,702,986 | 11/1987 | Imai et al. | 430/110 X |
| 4,737,432 | 4/1988 | Tanaka et al. | 430/110 |
| 4,740,443 | 4/1988 | Nakahara | 430/110 X |
| 4,741,984 | 5/1988 | Imai et al. | 430/110 X |

*Primary Examiner*—Paul R. Michl
*Assistant Examiner*—Jeffrey A. Lindeman
*Attorney, Agent, or Firm*—Fitzpatrick, Cella, Harper & Scinto

[57] ABSTRACT

A developer for developing electrostatic latent images comprises negatively chargeable toner particles and hydrophobic, negatively chargeable silica fine power, said silica fine powder being obtained by treating silica fine powder with a silane coupling agent represented by the following formula:

RmSiYn or $Y_3$—Si—NH—Si—$Y_3$ and treating further said treated silica fine powder with a silicone oil having the structure:

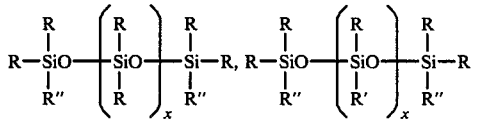

or

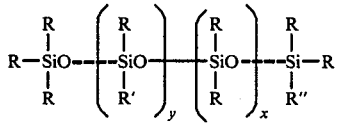

An image forming method comprises forming an electrostatic latent image on a photosensitive drum; developing said latent image with a developer to form toner images, said developer comprising negatively chargeable toner particles and, hydrophobic, negatively chargeable silica fine powder, said silica fine powder being obtained by treating silica fine powder with a silane coupling agent represented by the following formula:

RmSiYn or $Y_3$—Si—NH—Si—$Y_3$ and treating further said treated silica fine powder with a silicone oil having the structure:

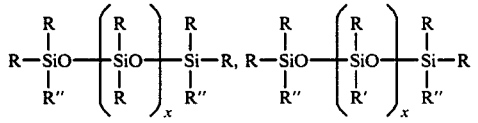

or

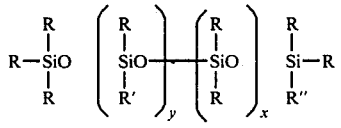

electrostatically transferring the toner images formed to a transfer material; and cleaning the photosensitive drum after electrostatic transfer with a blade cleaning means.

16 Claims, No Drawings

DEVELOPER FOR DEVELOPING ELECTROSTATIC LATENT IMAGE AND IMAGE FORMING METHOD

BACKGROUND OF THE INVENTION

1. Field of the Invention

This invention relates to a developer for developing electrostatic latent images in electrophotography, electrostatic recording, electrostatic printing, and an image forming method. More particularly, it pertains to an electrophotographic developer which can charge strongly and uniformly negative charges to give images of high quality with little dependence on environment in the direct or indirect electrophotographic developing method.

2. Related Background Art

In the prior art, electrophotogrphic methods as disclosed in U.S. Pat. Nos. 2,297,691, 3,666,363 and 4,071,361 have been known. Generally speaking, by utilizing a photoconductive substance, forming an electrical latent image on a photosensitive member according to various means, and then developing said latent image with the use of a developing powder (hereinafter called toner) and, after optionally transferring the toner image onto a transfer material such as paper, fixing the image by heating, pressure or heating under pressure or by use of a solvent vapor to give a copied product. When having the step of transferring the toner image, there is ordinarily provided a step for removing the residual toner on the photosensitive member.

As the method for visualizing the electrical latent images with the use of a toner, there may be included the magnetic brush method as disclosed in U.S. Pat. No. 2,874,063, the cascade developing method as disclosed in U.S. Pat. No. 2,618,552 and the powder cloud method as disclosed in U.S. Pat. No. 2,221,776. As the method of employing magnetic toner, there may be included the magnedry method by use of an electroconductive toner as disclosed in U.S. Pat. No. 3,909,258, the method of employing dielectric polarization of toner particles, and the charge delivery method by disturbance of the toner. Further, there is the method in which development is effected by propelling toner particles toward latent images, as disclosed in U.S. Pat. Nos. 4,356,245 and 4,395,476.

In the toner applied for these methods, there have been used in the art fine powder containing a dye and/or pigment dispersed in a natural or synthetic resin. For example, particles finely pulverized to about 1 to 30μ of a colorant dispersed in a binder such as polystyrene have been used as the toner. As the magnetic toner, those containing magnetic particles such as magnetite or ferrite have been used. On the other hand, in the case of a system employing two-component developers, a mixture of a toner with carrier particles such as glass beads or iron powder has been used.

In the method of using such dry system developer, in order to form visible images of good quality on the latent image carrier, the developer is required to have high flowing characteristic and have uniform chargeability. For this purpose, it has been practiced in the art to add and mix silica fine powder in toner powder. However, since silica fine powder is itself hydrophilic, the developer added with this powder may cause agglomeration due to humidity in the air to be lowered in flowing characteristic, or in an extreme case, may lower chargeability of the developer due to mositure absorption by the silica. For this reason, it has been proposed to use silica fine powder subjected to hydrophobic treatment in U.S. Pat. Nos. 3,720,617, 3,819,367, 3,983,045 and U.K. Patent No. 1,402,010. More specifically, it is the method in which silicon dioxide fine particles (silica fine powder) are reacted with a silane coupling agent to make them hydrophobic by replacement of silanol groups on the surface of the silicon dioxide fine particles with other organic groups. As the silane coupling agent, there are exemplified dimethyldichlorosilane, trimethylalkoxysilane, hexamethyldislazane and the like.

However, these silica fine powder, although modified to hydrophobic in nature to some extent, the extent of hydrophobic modification is not yet sufficient, and when left to stand under highly humid condition, the developer may tend to be lowered in charging performance. In recent years, copying machines, laser printers of small size and low price are appearing in the market. Thus, the circumstances in which these devices are used are not limited to offices with relatively good environmental conditions adjusted by means of air conditioner, but also are open to use in homes in general. Under such environment, it is necessary to maintain good copying quality even when left to stand under highly humid condition for a long term, and in this respect the silica fine powder subjected to hydrophobic modification of the prior art has still possess the points to be improved.

In recent years, copying machines or laser printers of small size and low price for personal use have appeared, and in these small size machines, there has been used the cartridge system in which the photosensitive member, the devloping instrument and the cleaning device are integrally assembled from the maintenance free standpoint. Since this cartridge is made disposable, an inexpensive organic photoconductive member (OPC) has been used as the photosensitive member. Further, as the mode suitable for personal use, the copying machine and laser printer itself is required to be miniaturized, and for this purpose a photosensitive with a small drum diameter has been demanded. Also, for the cleaning device, a blade cleaning for which the device can be made simple has been employed. Similarly, as the developer, it is preferable to use magnetic one-component system developer which makes the structure of the developing instrument simpler.

In such magnetic toner, the polishing effect of toner itself is strong, and when a photosensitive member with low surface hardness such as OPC is used as the photosensitive member and cleaning to effect strong pressure contact against the photosensitive member such as blade cleaning system is performed, with the use of the toner externally added with silica fine powder treated with a silane coupling agent of the prior art, photosensitive member contamination such as white drop-out due to cutting of the photosensitive member surface or toner fusion, black dots or filming due to damaging of the photosensitive member is liable to occur, to give rise to image defects in an extreme case. For avoiding such phenomenon, there has been known in the prior art the method to add a lubricant (e.g. fatty acid metal salt such as zinc stearate) in the toner. However, most of these lubricants have strong polarity and, when attached on the photosensitive surface, may frequently cause the trouble of image flowing under highly humid condition, thus having points to be improved.

In the prior art, in a digital copying machine or printer, latent images are constituted of basic picture elements (hereinafter called dots), and halftone images, solid black images and solid white images constituted of dots. Accordingly, during development, developing due to the edge effect is predominant. The edge effect is a phenomenon in which concentration of electrical lines of force occur at the boundary portion between the exposed portion and nonexposed portion of a latent image, whereby the surface potential of the photosensitive member is apparently raised to increase the image density at the boundary portion. In the prior art, in the analog development, this phenomenon is not favorable, because the solid image becomes nonuniform (image density increased at the end portion).

In the digital image forming method, in which a latent image is expressed with picture elements of 50 to 150 μm, since the portion receiving the edge effect is greater than the analog image in general, development with good line reproduction and high image density can be realized. The speciality of development of the edge portion resides in that unless the gradient of potential is great and the charging amount of developer or toner is sufficiently high, since the toner with greater charging amount is selectively used, the developer with low charging amount in the developing instrument is liable to reside in the machine, whereby deterioration will be readily caused after repeated copying of a large number of sheets. For this reason, it is important that the charging amount on the toner particles in the developer should be uniform.

This tendency poses frequently problems in deterioration of image during successive copying and narrowing of the line due to speciality of the edge phenomenon, particularly in such systems as laser printer, liquid crystal printer, etc., because of the primary output of letter images, among digital latent image systems.

In the prior art electrophotographic system, normal development has been primarily effected on the nonexposed portion. Recently, in the printer system in which image signals are expressed digitally, for elongation of life of the emitting body (semiconductor laser) to be used for developing exposure and improvement of image quality, it has been proposed to use the reversal developing system in which development is effected on the exposed portion with a toner of the same polarity as the latent image charges.

In the above reversal developing system, during developing, the toner is developed by the electric field at the site of the non-charge portion or the same polarity on the photosensitive member, and held on the photosensitive surface by the charges generated on the photosensitive surface through electrostatic induction of the toner having charges.

For the toner to be held stably at the reversal latent image position on the photosensitive member, it is necessary to increase the charging amount of the toner or developer which causes electrostatic induction.

In the reversal developing system, since the transfer material (plain paper or plastic sheet) is charged to the opposite polarity of the latent image charges on the photosensitive member during transfer, if the current contributing to transfer is increased, the winding phenomenon is liable to occur, in which transfer material and the photosensitive member are electrically adhered to each other.

For this reason, the transfer current has been limited to about half of the prior art, and in order to prevent lowering in transfer efficiency with low electrical field, the charging amount of the toner or developer is required to be made higher.

When a developer with low charging amount and broad charging amount distribution of toner particles group is supplied for a reversal developing system, during development, developability will be lowered to lower image density due to shortage in charging amount. Further, since the toner with good charging amount is preferentially consumed, in toner or developer with relatively lower in charging amount remain such on the developing sleeve, whereby image deterioration will occur by successive copying.

During transfer, due to shortage in charging amount, transfer efficiency is lowered to lower the image density, and also the toner with smaller charging amount can be restricted by the electrical field with difficulty, and therefore scattering of the toner will occur during transfer to cause lowering in image quality.

In any case, in the system having the development-transfer mechanism of the normal developing system of the prior art, although the influence may be small, shortage in charging amount of the developer becomes particularly the problem in the case of the reversal developing system. In the reversal development practiced in laser printer, due to smaller chages of electrostatic latent images on the image portion and greater charges of the background on the photosensitive member, the toner is carried on the background with greater charges on the photosensitive member if a toner with smaller charge amount exists. Prevention of this reversal fogging phenomenon has been the most important task in the reversal developing process.

SUMMARY OF THE INVENTION

An object of the present invention is to provide a developer for developing static charges which is also stable under the environmental conditions of high temperature-high humidity and low temperature-low humidity, and can constantly exhibit good characteristics.

Another object of the present invention is to provide a developer which is excellent in durability and capable of obtaining stable images even when a large number of images are formed over a long term in an electrophotographic method, including developing, electrostatic transfer, fixing and cleaning processes.

A further object of the present invention is to provide a developer which solves various problems involved in the chargeable toner, can be negatively charged uniformly and strongly and can visualize the electrostatic images to give images of high quality without fogging or scattering of toner around the edges.

Still another object of the present invention is to provide a developer, which will generate image defect by cutting or contamination of the photosensitive member surface which occurs in a cleaning system such as blade cleaning system in the case of using a photosensitive member with low surface hardness.

A still further object of the present invention is to provide a developer which can give high image density without causing troubles such as image flow under highly humid condition.

Still another object of the present invention is to provide a cleaning method excellent in durability which is free from generation of image defect caused by cutting or contamination of the photosensitive member surface which may occur when blade cleaning is performed for a photosensitive member with a surface hardness of 30 g or less, and is also free from trouble such as image flowing under highly humid condition.

A still further object of the present invention is to provide a developer which can maintain good image quality even when used for a digital latent image system.

A still further object of the present invention is to provide a developer which can be well applied for an electrophotographic system having a transfer system having a reversal developing system and using a low transfer current.

Still another object of the present invention is to provide a developer which can permit latent images to be developed and transferred faithfully in developing of digital latent images.

A still further object of the present invention is to provide a developer which can give high image density without adhesion of the toner in the background region during developing and without fogging and scattering of the toner around the edges of the digital latent image.

Still another object of the present invention is to provide a developer suitable for developing of digital latent images, which can maintain the initial characteristics even when the developer is continuously used for a long term, and is free from agglomeration of the toner and change in negatively chargeable characteristic.

Still another object of the present invention is to provide a developer suitable for developing of digital latent images, which can reproduce stable images receiving no influence from changes in termperature and humidity, particularly without scattering or transfer drop-out during transfer when humidity is high or low.

A still further object of the present invention is to provide a developer suitable for developing of digital latent image which can maintain initial characteristics even during storage for a long term.

Still another object of the present invention is to provide a developer which can be preferably used for an image forming method in which a photosensitive member of small diameter drum (50 mmϕ or less) is used.

According to one aspect of the present invention, there is provided a developer for developing electrostatic latent images, comprising negatively chargeable toner particles and hydrophobic, negatively chargeable silica fine power, said silica fine powder being obtained by treating silia fine power with a silane coupling agent represented by the following formula:

RmSiYn or $Y_3$—Si—NH—Si—$Y_3$ wherein R represents alkoxy group or chlorine atom, Y represents alkyl group, m represents positive integer of 1 to 3 and n represents positive integer of 3 to 1, with proviso that m+n is 4, and treating further said treated silica fine powder with a silicone oil having the structure:

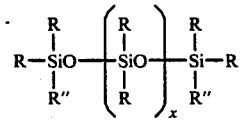

or

-continued

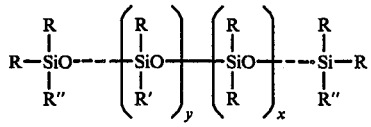

wherein R represents alkyl group having 1 to 3 carbon atoms, R′ represents alkyl group different from R having 1 to 10 carbon atoms, halogen-modified alkyl group having 1 to 10 carbon atoms, phenyl-modified alkyl group or phenyl group, R″ represents alkyl group having 1 to 3 carbon atoms or alkoxy group having 1 to 3 carbon atoms (with proviso that R″ represents a group which may be either the same as or different from R), and x and y each represent positive integer.

According to another aspect of the present invention, there is provided an image forming method which comprises forming an electrostatic latent image on a photosensitive drum; developing said latent image with a developer to form toner images, said developer comprising negatively chargeable toner particles and, hydrophobic, negatively chargeable silica fine powder, said silica fine powder being obtained by treating silica fine powder with a silane coupling agent represented by the following formula:

RmSiYn or $Y_3$—Si—NH—Si—$Y_3$ wherein R represents alkoxy group or chlorine atom, Y represents alkyl group, m represents positive integer of 1 to 3 and n represents positive integer of 3 to 1, with proviso that m+n is 4, and treating further said treated silica fine powder with a silicone oil having the structure:

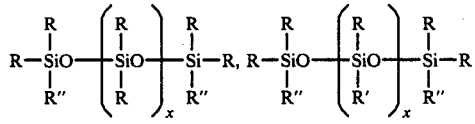

or

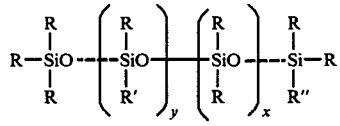

wherein R represents alkyl group having 1 to 3 carbon atoms, R′ represents alkyl group different from R having 1 to 10 carbon atoms, halogen-modified alkyl group having 1 to 10 carbon atoms, phenyl-modified alkyl group or phenyl group, R″ represents alkyl group having 1 to 3 carbon atoms or alkoxy group having 1 to 3 carbon atoms (with proviso that R″ represents a group which may be either the same as or different from R), and x and y each represent positive integer;

electrostatically transferring the toner images formed to a transfer material; and cleaning the photosensitive drum after electrostatic transfer with a blade cleaning means.

DETAILED DESCRIPTION OF THE PREFERRED EMBODIMENTS

In the silane coupling agent treatment of the prior art, it is difficult to block all the silanol groups of silica fine powder. Water absorption of remaining silanol group under high humidity can be prevented by hydrophobic property and steric hindrance of organic groups due to the silane coupling agent, but it is difficult to prevent well water absorption of remaining silanol group.

In the silicone oil treatment, by coating of the silicone oil on the surface of silica fine powder, silanol groups can be covered, whereby humidity resistance can be dramatically improved. However, only by the silicone oil treatment, much amount of the silicone oil for coverage over the silica fine powder surface is required to be used. For this reason, agglomerates of silica fine powder are readily formed during the treatment, whereby there ensues the problem that flowability of the developer is worsened when added into the developer. The present inventors, in view of the above facts, have studied intensively and consequently found that, for precluding formation of agglomerates of silica fine powder while maintaining good humidity resistance, the above problems can be overcome by treating the silica fine powder with an alkyl coupling agent and thereafter treating the treated powder with a specific silicone oil.

In an electrophotographic process having a cleaning system in which a blade such as rubber blade is pressure contacted against a photosensitive member with surface hardness of 30 g or less (e.g. surface hardness 15–30 g), the developer of the present invention containing silica fine powder subjected further to the silicone oil treatment after the treatment with a silane coupling agent exhibits good developing characteristic and cleaning characteristic.

The silica fine powder according to the present invention is specific in that the silane coupling agent is secured onto the silica fine powder surface by chemical bond, on which is further applied the silicone oil treatment (surface coating type), and in that due to lubricating property possessed by the silicone oil, the photosensitive member surface will be cut or damaged with difficulty even when the photosensitive member surface may be strongly rubbed with a cleaning blade. Here, in the case of the treatment only with the silicone oil, much amount of silicone oil is needed for covering completely the surface of silica fine powder, whereby there will ensue the problem as described above that agglomerates of silica will be readily formed to cause damages of the photosensitive member.

In the silica fine powder in the present invention, since the silica fine powder is treated first with a silane coupling agent, the amount of the silicone oil which may cause formation of agglomerates can be reduced, whereby the advantages of the silicon oil treatment can be utilized while overcoming the above drawbacks.

In the case of an electrophotographic process by use of a photosensitive drum of small diameter (50 mmϕ or less), the drum rotational number per one sheet of copying is large and the radius of curvature of the photosensitive is large, and therefore the contact pressure of the blade against the photosensitive member surface must be made greater. For this reason, damages are liable to occur on the photosensitive member surface. The developer of the present invention is very effective in an electrophotographic process by use of a photosensitive member in which a drum of small diameter (50 mmϕ or less, for example, 20–40 mmϕ) is used.

The photosensitive member on the small diameter drum is primarily OPC, and its surface hardness is measured as follows. By use of Haydon 14 type scratching hardness meter and a diamond needle of R 0.01 mm, the photosensitive surface is scratched under the state applied with a load, and the hardness is expressed in terms of the load when the width of its scar becomes 40μ.

For blade cleaning, pressure contact form of a rubber plate can be used. For example, as such blade, one having rubber strength of 20°–70°, preferably 20°–60°, and a penetration amount during blade cleaning of about 0.1 to 2 mm may be used.

The developer of the present invention containing the silica fine powder treated with silicone oil after treatment with a silane coupling agent will exhibit the effect when used in the reversal developing system employing an effective transfer current of $1\times10^{-7}$ to $10\times10^{-7}$ (A/cm).

The transfer current in the present invention is determined by having electroconductive electrodes sufficiently wider than the transfer material such as plain paper (PPC) at the position corresponding to the transfer position of the photosensitive member, and dividing the current value passing through the electroconductive electrodes when the electrical circuit for transfer is turned on the actuation state by its length.

In the silica fine powder of the present invention, since treatment is finally effected with a specific silicone oil having strong negative chargeability, the treated silica fine powder will be strongly negatively charged. Accordingly, when said silica fine powder is added to the developer, strong and uniform negative chargeability can be given to the developer. This characteristic is effective, particularly for insulating negatively chargeable onec-omponent magnetic toner which is liable to become unstable in charging.

For the silica fine powder to be used in the present invention, both of the dry process silica formed by vapor phase oxidation of a silicon halide compound or the dry process silica called fumed silica, and the wet process silica prepared from the starting material such as water glass may be available. However, it is preferable to use the dry process silica containing little silanol group on the surface or internally of silica particles, and having substantially no production residue such as $Na_2O$, $SO_{32-}$.

In the dry process silica, it is also possible to obtain a composite fine powder of silica with other metal oxides by use of other metal halide compounds such as aluminum chloride or titanium chloride together with a silicon halide compound in the preparation steps. The silica fine powder of the present invention is also inclusive of such powder.

The silica fine powder should preferably have an average primary particle size within the range from 0.001 to 2μ, particularly from 0.002 to 0.2μ.

Further, the silica fine powder when viewed in specific surface area, should preferably have a BET specific surface area as measured by nitrogen adsorption of 40 to 400 $m^2/g$, preferably 50 to 350 $m^2/g$, particularly preferably 70 to 300 $m^2/g$.

The alkylsilane coupling agent to be used in the present invention is represented by the following formula:

$$RmSiYn \text{ or } Y_3—Si—NH—Si—Y_3$$

wherein R represents alkoxy group or chlorine atom, Y represents alkyl group, m represents positive integer of 1 to 3 and n represents positive integer of 3 to 1, with proviso that m+n is 4.

When R is an alkoxy group, it may preferably be a group having 1 to 3 carbon atoms. Y may preferably be an alkyl having 1 to 10, preferably 1 to 8 carbon atoms, for making silanol groups hydrophobic. Specifically, there may be included alkylsilane coupling agents such as dimethylidichlorosilane [$(CH_3)_2$− Si—$(Cl)_2$], trimethylchlorosilane[$(CH_3)_3$—Si—Cl], hexamethyldisilazane [$(CH_3)_3$—Si—NH—Si—$(CH_3)_3$].

As the alkylsilane coupling agent treatment of silica fine powder, there is the dry treatment method, in which silica fine powder is made cloudy by stirring and the gasified alkylsilane coupling agent is reacted with the silica fine powder. Further, treatment by the wet treatment may be possible, in which silica fine powder is dispersed in a solvent, and the alkylsilane coupling agent is added dropwise to thereby effect the reaction between the silica fine powder and the alkylsilane coupling agent. The silica fine powder treated with the silane coupling agent may be preferably subjected to heat treatment at a temperature of 50° to 150° C. for enhancing hydrophobicity and flowing characteristic.

The silicone oil to be used in the present invention is represented by the following formula:

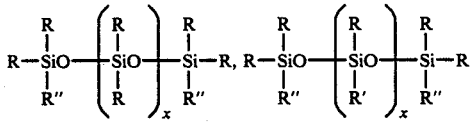

or

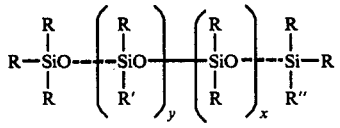

wherein R represents alkyl group having 1 to 3 carbon atoms, R′ represents alkyl group different from R having 1 to 10 carbon atoms, halogen-modified alkyl group having 1 to 10 carbon atoms, phenyl-modified alkyl group or phenyl group, R″ represents alkyl group having 1 to 3 carbon atoms or alkoxy group having 1 to 3 carbon atoms, and x and y each represent positive integer.

Specifically, there may be exemplified dimethyl-silicone oil

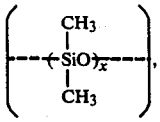

alkyl-modified silicon oil having R′ ($C_2$–$C_{10}$)

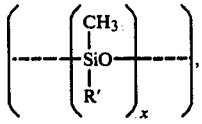

α-methyl-styrene modified silicone oil

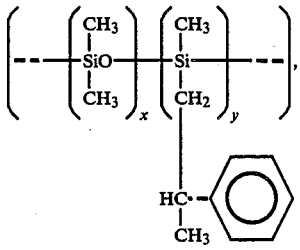

chlorophenylsilicone oil

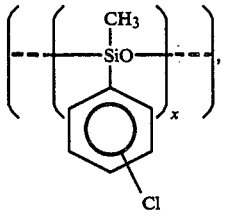

fluorine modified silicone oil having trifluoromethyl

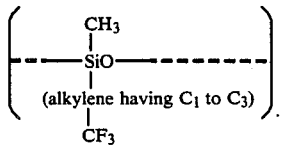

The silicone oil to be used in the present invention should preferably have a viscocity at 25° C. of 50 to 1000 centistokes. A silicone oil of low molecular weight with too low viscosity is not preferable for having volatile components, while a silicone oil of high molecular weight with too high viscosity is not preferable, because it can be coated uniformly onto silica fine powder with difficulty.

As the method for further subjecting the silica fine powder treated with the silane coupling agent to silicone oil treatment, there may be exemplified the method in which said fine powder and the silicone oil are directly mixed by means of a mixer such as a Henscel mixer or the method in which the silicone oil is sprayed on the silica fine powder. Further, after the silicone oil is dissolved or dispersed in n-hexane or methyl ethyl ketone, it may be mixed with the silica fine powder of the base, followed by removal of the solvent to prepare the silica fine powder treated with the silicone oil. When the silicone oil is mixed with a solvent, for enhancing the diluting effect, it is preferable to use 2 to 10 parts by weight of the solvent per 1 part by weight of the silicone oil. The silica fine powder treated with the silicone oil should be preferably subjected to heat treatment at a temperature of 150° to 350° C., preferably 200° to 300° C., for enhancing hydrophobicity and flowing characteristic.

As an important point in the present invention, there is the order in which the silica fine powder is treated. The silica fine powder of the present invention is required to be treated with a specific silicone oil after treated with an alkylsilane coupling agent. According to the method in which treatment with a silane coupling agent is performed after the treatment with the silicone oil, the alkylsilane coupling agent cannot react efficiently with the silanol groups of the silica particle surface, whereby free alkylsilane coupling agent will remain. Simultaneous treatments with the alkylsilane coupling agent and with the silicone oil may be conceivable, but simultaneous treatments cannot result in successful hydrophobic treatment of silica fine powder, whereby silica fine powder made sufficiently hydrophobic can be obtained with difficulty. The reason is not clear, but it may be considered that by competition between attachment of the silicone oil and the reaction of the alkylsilane coupling agent, the alkylsilane coupling agent cannot react well with the silanol groups of the silica fine powder, whereby free alkylsilane coupling agent remains.

Further, it may be considered that the reaction between the silicone oil and the alkylsilane coupling agent may occur during mixing.

The hydrophobicity of the silica fine powder in the present invention is measured according to the following method. In a stoppered 250 ml vessel, about 100 ml of pure water and about 1 g of a sample are placed, and the mixture is shaked by a shaking machine such as Shaker-mixer T2C type produced by TURBULA Co. under the condition of 90 rpm for 10 minutes. After shaking, the mixture is left to stand for 1 minute to effect separation between the silica powder layer and the aqueous layer. The aqueous layer is collected, andn transmittance of the aqueous layer is meausred at wavelength of 500 mm with the reference of pure water as blank, and the value of transmittance is evaluated as the hydrophobicity of the treated silica.

The hydrophobic silica fine powder in the present invention should preferably have a hydrophobicity of 90% or higher (preferably 95% or higher). If the hydrophobicity is lower than 90%, there is increased tendency to give no image of high quality due to water absorption by the silica fine powder under high temperature and high humidity conditions. Further, the treated silica fine powder according to the present invention should particularly preferably have a methanol hydrophobicity as described below of 65 or higher for maintaining flowing characteristic and triboelectric chargeability under high temperature and high humidity conditions. The "methanol titration test" defined in the present invention for evaluation of methanol hydrophobicity is conducted as follows.

Sample fine silica particles (0.2 g) are charged into 50 ml of water in a 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the methanol hydrophobicity is represented by the percentage of the methanol in the liquid mixture of water and methanol based on the quantity of methanol added on reaching the end point.

If the hydrophobicity is low at the stage of treatment with the alkylsilane coupling agent, much amount of silicone oil is required at the next stage of the silicone oil treatment.

The treatment amount of the alkysilane coupling agent in the present invention may also differ depending on the number of halogenic groups or alkoxy groups of the alkylsilane coupling agent, but in view of the number of silanol groups in the silica fine powder (generally 2–3/Å$^2$ in the dry process silica), an amount capable of reacting with 50% or more, preferably 70% or more, of silanol groups should be employed.

It is preferable to use an alkylsilane coupling agent in an amount of 5 to 40 parts by weight, preferably 10 to 30 parts by weight, based on 100 parts by weight of silica fine powder with a BET specific surface area of 40 to 400 m$^2$/g.

The treatment amount of the silicone oil based on 100 parts by weight of the silica fine powder may be preferably $A/25 \pm A/30$ parts by weight (in the formula, A is a numerical value of the specific surface area of the silica fine powder), more preferably $A/25 \pm A/40$ parts by weight, because the silica fine powder is made hydrophobic with the alkylsilane coupling agent. Here, the specific surface area of the silica fine powder is the value determined by $N_2$ adsorption in the BET method. The reason why the above treatment amount is limited is because, if the treatment amount of the silcione oil is too small, there is little improvement of humidity resistance similarly as the case of only the treatment with the alkylsilane coupling agent, and no copied toner image of high quality can be obtained under high humidity due to moisture absorption by the silica fine powder. If the silicone oil treatment amount is too much, agglomerates of the silica fine powder will be readily formed. In an extreme case, free silicone oil not carried on silica particles may exist, and therefore there may sometimes ensue the problem that when the silica fine powder is added into the developer, the flowing characteristic of the developer cannot be improved.

The amount of the treated silica powder applied to the developer may be 0.01 to 20 parts by weight, preferably 0.1 to 3 parts by weight, based on 100 parts by weight of the toner.

As the binder resin for the toner to be used in the present invention, there may be employed homopolymers of styrene and its derivatives and copolymers thereof such as polystyrene, poly-p-chorostyrene, polyvinyltoluene, styrene-p-chlorostyrene copolymer, styrene-vinyltoluene copolymer; copolymers of styrene and acrylic acid ester such as styrene-methyl acrylate copolymer, styrene-ethyl acrylate copolymer, styrene-n-butyl acrylate copolymer, styrene-2-ethylhexyl acrylate copolymer; copolymers of styrene and methacrylic acid ester such as styrene-methyl methacrylate, styrene-ethyl methacrylate, styrene-n-butyl methacrylate, styrene-2-ethylhexyl methacrylate; multi-component copolymers of styrene, acrylic acid ester and methacrylic acid ester; styrene copolymers of styrene with other vinyl monomers such as styrene-acrylonitrile copolymer, styrene-vinyl methyl ether copolymer, styrene-butadiene copolymer, styrene-vinyl methyl ketone copolymer, styrene-acrylonitrile-indene copolymer, styrene-maleic acid ester copolymer; polymethyl methacrylate, polybutyl methacrylate, polyvinyl acetate, polyester, epoxy resin, polyvinyl butyral, polyacrylic acid resin, phenolic resin, aliphatic or alicyclic hydrocarbon resin, petroleum resin, chlorine paraffin, either individually or as a mixture.

Particularly, as the binder resin for the toner provided for the pressure fixing system, there can be used low molecular weight polyethylene, low molecular weight polypropylene, ethylene-vinyl acetate copolymer, ethylene-acrylic acid ester copolymer, higher fatty acid, polyester resin, either individually or in a mixture.

In the present invention, more preferable results can be obtained if 40% by weight or more based on the resinous component in the toner of an vinyl aromatic monomer such as styrene or an acrylic monomer is contained in the polymer, copolymer or polymer blend used as the binder resin.

The toner contains a pigment or a dye as the colorant. For example, dyes or pigments such as Carbon Black, Iron Black, Phthalocyanine Blue, Ultramarine, Quinacridone, Benzidine Yellow, may be included. The content of the colorant may be preferably 0.1 to 20 parts by weight based on 100 parts by weight of the binder resin.

When the toner is made a magentic toner, there may be incorporated powder (average particle size 0.1–1 μm) ferromagnetic elements such as iron, cobalt, nickel; alloys or compounds of iron or iron with cobalt, nickel, manganese, such as magnetite, hematite, ferrite; other ferromagnetic alloys, as the magnetic material. The magnetic material may be used in an amount of 10 to 200 parts by weight, preferably 50 to 150 parts by weight, based on 100 parts by weight of the binder resin.

In the developer, additives may be also mixed, if necessary. Examples of the additives may include lubricants such as Teflon powder, zinc stearate powder, fixing aids (e.g. low molecular weight polyethylene, low molecular weight polypropylene), and metal oxides such as tin oxide as the conductivity imparting agent. Preferably, for stabilizing negative chargeability of the negatively chargeable toner particles according to the present invention, 0.1 to 10 parts by weight of negatively chargeable controlling agent(s) may be contained per 100 parts by weight of the binder resin.

The toner according to the present invention may contain a metal complex compound (A) of an aromatic hydroxycarboxylic acid having lipophilic group and a metal complex salt type monoazo dye (B) having hydrophilic group as the negative charge controlling agents.

Here, lipophilic group refers to an atomic group of non-polarity which is very small in affinity for water, and therefore great in affinity for oil. Primary lipophilic groups may include chain hydrocarbon group, alicyclic hydrocarbon groups or aromatic hydrocarbon group.

The lipophilic group possessed by the metal complex compound (A) in its structural formula may be preferably a chain hydrocarbon (particularly alkyl group) directly bonded to a cyclic (monocyclic or polycyclic) hydrocarbon.

In the metal complex (A) having such lipophilic group, the aromatic hydroxycarboxylic acid which is the ligand should preferably have a benzene nucleus or a napthalene nucleus, and further preferably coordinated through carboxylic group and hydroxyl group with the metal atom.

On the other hand, the above hydrophilic group refers to a polar group having strong interaction with water. Primary hydrophilic groups may include $-SO_3H$, $-SO_3M$, $-COOM$, $-NR_3X$, $-COOH$, $-NH_2$, $-CN$, $-OH$, $-NHCONH_2$, $-X$, $-NO_2$ (here R represents an alkyl group, M an alkali metal or $-NH_4$). In the present invention, as the hydrophilic group, halogen (—X), carboxyl (—COOH), hydroxyl (—OH), nitro ($-NO_2$), sulfone ($-SO_3H$), sulfoamino ($-SO_3NH_4$) group may be preferably used.

The monoazo dye (B) having such hydrophilic group should peferably have benzene nucleus or naphthalene nucleus in the ligand, preferably having a structure of O,O'-dioxyazo form.

The lipophilic group and hydrophilic group should be preferably directly bonded to the monocyclic or polycyclic hydrocarbon group (e.g. benzene nucleus, naphthalene nucleus) in the structural formula.

These compounds A, B, when added individually into the toner, will both exhibit similar effect as the negative charge controlling agent. Further, in the present invention, by utilizing the interaction when these compounds A, B are combined, uniformization of distribution of triboelectric charges (negative charges) is realized.

Further, in the toner of the present invention, for further enhancing the combination effect of the compounds A, B, it is desirable to satisfy one of the conditions as mentioned below.

(1) The metal atoms in the metal complexes of the compounds A, B used in combination should be the same. This is preferable for making compatibilities of the both compounds with the binder resin substantially equal to each other.

(2) The metal atom in the metal complex should be Cr. This is preferable for enhancing chargeability of the toner.

(3) The particle sizes of the compounds A, B should be preferably smaller for improvement of dispersibility in the binder resin. Specific numerical values should desirably be 9.0 μm or less in terms of volume average particle size ($\bar{d}v$), and 5.0 μm or less in terms of number average particle size ($\bar{d}n$).

(4) The compounds A, B should have substantially the same electrical resistances. Specifically, the volume resistivity ratio of the compound A/the compound B should be preferably $10^{-3}$ to $10^{3}$ for uniformization of triboelectric charges of the toner.

As specific examples of the above compound A, salicylic acid type or naphthoic acid type metal complexes represented by the formulae (I), (II) or (III) shown below may be preferably employed.

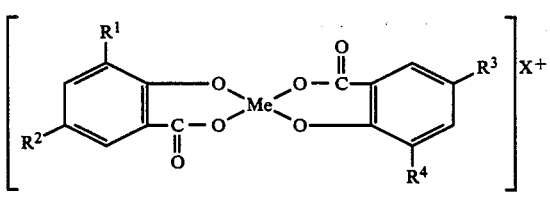

(I)

-continued (II)

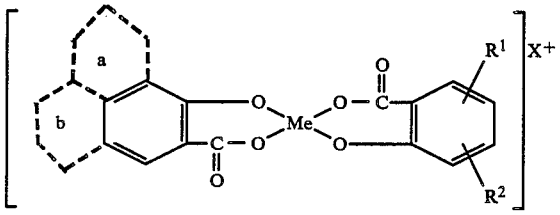

(III)

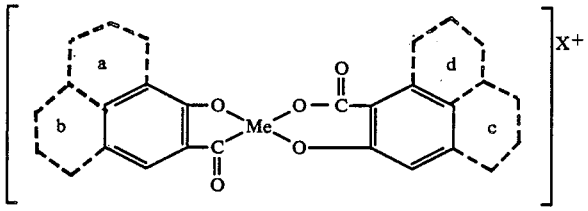

In the above formulae (I) through (III): $R^1$–$R^4$: either identical or different, and each represents hydrogen or a hydrocarbon group or $C_{10}$ or less (alkyl group or alkenyl group, etc.); with proviso that in the formula (I), at least one of $R^1$–$R^4$ represent the above hydrocarbon group;

a, b: $C_4$–$C_9$ hydrocarbon group (alkyl group, etc.), benzene ring or cyclohexene ring; with proviso that in the formula (II), in either a or b, there is the above hydrocarbon group, and in the formula (III), in either of a or b, and c or d, there is the above hydrocarbon group;

$X^+$ (counter ion): $H^+$, $K^+$, $Na^+$, $NH_4^+$, $Li^+$, etc.;

Me: Cr, Nr, Co, Cu, Zn, etc.

In the salicylic acid or naphtholic acid type metal complex represented by the formulae (I) through (III), as the alkyl group represented by $R^1$, $R^2$, $R^3$, $R^4$, those having 5 or less carbon atoms can be readily introduced, and tertiary butyl group, tertiary amyl group or an alkyl group with less carbon atoms may be preferably used. In the present invention, 3,5-ditertiary butyl-salicylic acid complex compound, monotertiary-butyl salicylic acid chromium complex compound may be particularly preferably used.

As also represented by the above formulae, in the metal complex compound A, the ligands bonded to the metal atom may not be the same. In this case, of these ligands, at least one ligand may be the ligand of the aromatic hydroxycarboxylic acid having lipophilic group.

As such metal complex compound A, more specifically, there may be particularly preferably used to complex compounds having the following formulae:

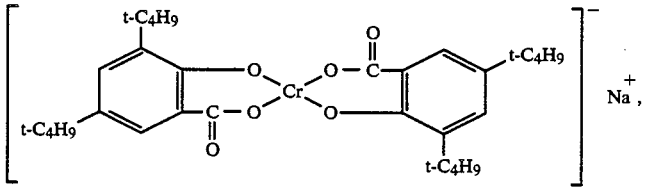

or

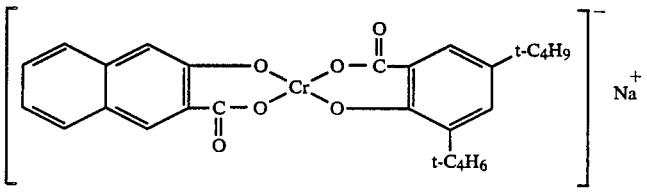

On the other hand, as the metal complex salt type monoazo dye B, metal complex salt type monoazo dyes can be conveniently used.

As the monoazo dye, the metal complex type monoazo dye having a coupling product of phenol or naphthol derivative as the ligand, having the structural formula (IV) or (V) shown below may be preferably used:

(IV)

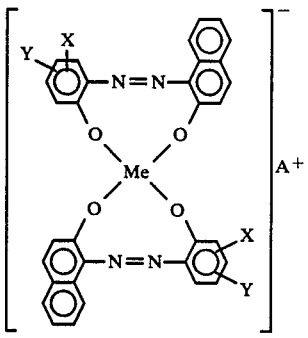

-continued (V)

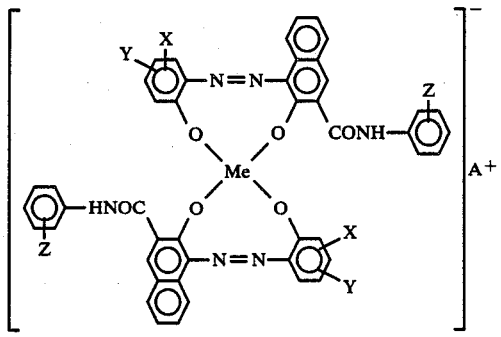

As the metal complex compound B, more specifically, the complex compound having the following structure may be particularly preferably used:

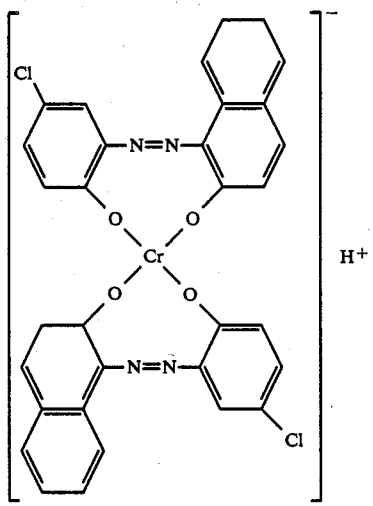

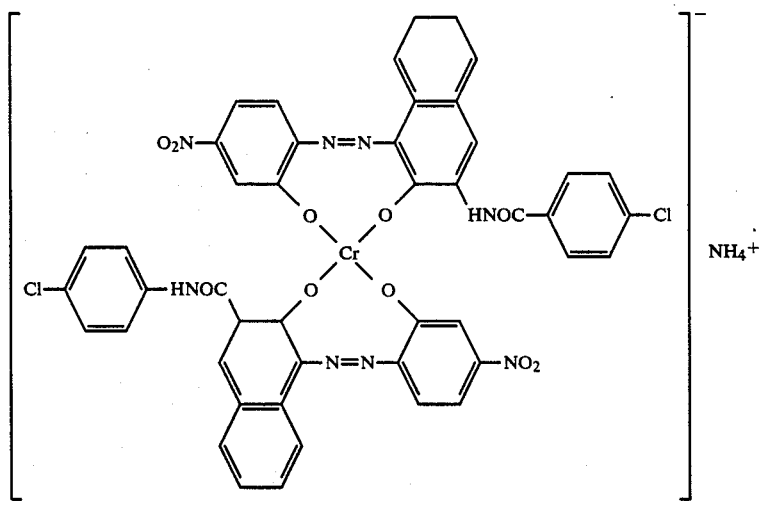

The ratio of the compounds A, B as described above based on the binder resin added should be preferably the compound A/the compound B=1/10–10.0/1, more preferably ⅓–3.0.

The total amount of the compounds A, B added may be 0.1 to 10.0 parts by weight, preferably 0.2 to 6 parts by weight, particularly 0.5 to 4.0 parts by weight, based on 100 parts by weight of the binder resin.

In the following, the method for preparing the toner containing the compounds A and B is described below.

(1) A binder resin and the compound (charging controlling agents) A and B (sometimes further magnetic material and dye or pigment as the colorant are added) are uniformly dispersed by a mixer such as a Henscel mixer.

(2) The dispersion obtained as described above is melted and kneaded by a melting kneader such as kneader, extruder, roll mill, etc.

(3) The mass obtained by cooling the kneaded product is crushed coarsely by a crusher such as cutter mill, hammer mill, and then finely pulverized by jet mill.

(4) The finely pulverized product is regularly distributed in particle size by use of a wind force classifier.

(5) The classified product obtained above is mixed with the treated silica fine powder, added optionally with external addivitives such as fluorine type resin fine powder, metal oxides, and mixed by means of a mixer such as a Henscel mixer to obtain a developer.

Otherwise, as the method for preparation of the developer of the present invention, the polymerization method, the capsule method can be used.

The developer (toner) of the present invention thus constituted can obtain good cleaning characteristic even under the environments of high temperature-high humidity, low temperature-low humidity, etc.

Having described above about the basic constitution and the specific features of the present invention, the method of the present invention is described below by referring to Examples.

In the Examples, parts mean parts by weight.

EXAMPLE 1

Styrene-butyl acrylate-butyl maleate half ester copolymer: 100 parts
Magnetic material (magnetite, average particle size 0.3 μm): 60 parts
Chromium alloy organic complex: 2 parts
Polypropylene wax: 4 parts The above mixture was kneaded on roll mill at 150° to 160° C. and after cooling pulverized by jet mill, and the particles primarily of 5–20μ in size were classified by wind force to obtain a negatively chargeable magnetic toner classified product with a number average particle size of about 8μ.

Next, 100 parts by weight of silica fine powder [BET specific surface area 200 $m^2/g$, Aerosil #200, produced by Nippon Aerosil Co.] were applied with silane coupling treatment with 20 parts by weight of hexamethylenedisilazene (HMDS), then subjected to heat treatment at 110° C. The treated product (100 parts by weight) was again treated with 10 parts by weight of dimethylsilicone oil (KF 96, viscosity 100 cs, produced by Shinetsu Kagaku) diluted with a solvent and after drying subjected to heat treatment at 250° C. to obtain silica fine powder treated with dimethylsilicone oil. To 100 parts by weight of the magnetic toner classified produce as described above, 0.4 parts by weight of the silica fine powder were externally added to obtain a developer having a magnetic toner. The treated silica fine powder was found to have a hydrophobicity of 98%. Further, the treated silica fine powder was found to have a methanol hydrophobicity of 68. A copying machine having an OPC photosensitive drum of small diameter with surface hardness of 21 g (FC-3, produced by Canon, drum diameter 30 ϕmm) was modified so as to be capable of reversal developing, and image forming test was conducted with the developer obtained, under the conditions of a drum charging amount −700 V, $V_{DC}$ 500 V, developing bias Vpp 1600 V, frequency 1800 Hz, drum-sleeve distance 270μ. The toner image on the photosensitive drum was transferred onto a plain paper by corona transfer at an effective transfer current of $6\times10^{-7}$ (A/cm), and the photosensitive drum surface after transfer was subjected to blade cleaning with a urethane rubber blade (penetration amount of blade, about 0.7 mm). Under the conditions of normal temperature and normal humidity (temperature 23° C., humidity 60% RH), good image could be obtained. When successive copying test was performed by use of this copying machine under low temperature and low humidity (temperature 15° C., humidity 10% RH), high temperature and high humidity (temperature 32.5° C., humidity 90% RH), there occurred no image badness such as filming, toner fusion, drum damage, image flow, image white drop-out, etc. even after successive copying of 5000 sheets.

EXAMPLE 2

Hydrophobic silica fine powder was obtained in the same manner as in Example 1 except for changing the dimethylsilicone oil treatment amount relative to silica fine powder to 3 parts by weight. A developer was prepared in the same manner as in Example 1 by use of this silica fine powder, and 5000 sheets of successive copying was performed under the respective environments. Good results were obtained.

EXAMPLE 3

Hydrophobic silica fine powder was obtained in the same manner as in Example 1 except for changing the dimethylsilicone oil treatment amount relative to silica fine powder to 12 parts by weight. A developer was prepared in the same manner as in Example 1 by use of this silica fine powder, and 5000 sheets of successive copying was performed under the respective environments. The results were good and no image flowing or toner fusion occurred.

COMPARATIVE EXAMPLE 1

A developer was prepared by use of 100 parts by weight of the magnetic toner used in Example 1 to which 0.4 parts by weight of silica fine powder only applied with silane coupling treatment with hexamethylenesilazene were externally added. When the same tests as in Example 1 were conducted, image flowing occured after copying of about 3,000 sheets under high temperature and high humidity, while under low temperature and low humidity, toner fusion onto the drum surface occurred after about 3,500 sheets of copying.

COMPARATIVE EXAMPLE 2

In addition to 0.4 parts of the silica fine powder obtained similarly as in Comparative example 1, 0.03 parts of zinc stearate were added to obtain a developer similarly as in Example 1. When the same tests as in Example 1 were performed, although no toner fusion occurred by successive copying of 5,000 sheets under low temperature and low humidity, image flowing occurred after about 2,000 sheets under high temperature and high humidity.

As described above, in an electrophotographic process in which cleaning is performed by pressure contact of a rubber blade against a photosensitive member with small surface hardness, the developer containing the silica fine powder subjected to silicone oil treatment after the treatment with a silane coupling agent can give a good image, while avoiding image defect by cutting or contamination of the photosensitive surface. In a photosensitive drum of small diameter with a large radius of curvature, this effect is marked, whereby durability of the photosensitive member can be improved to enhance cleaning characteristic.

EXAMPLE 4

Styrene-butyl acrylate-butyl maleate anhydride copolymer
(weight average M.W. about $35\times10^4$): 100 parts
Magnetic material (magnetite, average diameter 0.2μ): 60 parts
Chromium organic complex: 2 parts
Polypropylene wax: 4 parts The above mixture was kneaded on roll mill at 150° C. to 160° C., pulverized after cooling by jet mill, and classified by wind force to obtain a negatively chargeable insulating magnetic toner classified product of 5 to 20μ. The magnetic toner classified product was found to have a volume average particle size of about 12μ. Further, 100 parts by weight of an iron powder carrier (200 mesh pass-300 mesh on particle size) and 10 parts by weight of the magnetic toner classified product were mixed for about 20 seconds, and the triboelectric charges were measured by the blow-off method to have a negative chargeability of −17μc/g.

Next, after 100 parts by weight of silica fine powder with BET specific surface area 200 $m^2/g$ (Aerosil #200 (produced by Nippon Aerosil Co.)) were treated with 20 parts by weight of hexamethyldisilazane (HMDS), heat treatment was effected at a temperature of 110° C. and further the treated product was treated with 10 parts by weight of dimethylsilicone oil (KF-96 100 cs, produced by Shinetau Kagaku) diluted with a solvent (40 parts by weight of n-hexane). After drying by removal of the solvent, the produce was subjected to heat treatment at about 250° C. to obtain hydrophobic, negatively chargeable silica fine powder. The silica fine powder obtained was found to have a hydrophobicity of 99. Further, the silica fine powder obtained was found to have a methanol hydrophobicity of 70.

Further, 2 parts by weight of the silica fine powder obtained and 100 parts by weight of an iron powder carrier (200 mesh on-300 mesh pass particle size), and the triboelectric charging characteristic of the silica fine powder was measured to find what it had negative charges of −200μc/g.

By blending 0.4 parts by weight of said silica with 100 parts by weight of said magnetic toner classified product, a negatively chargeable insulating one-component magnetic developer was prepared.

By use of the one-component developer obtained, image forming test was conducted by means of a commercially available copying machine Selex 60AZ (produced by Copier). The copying machine used contained a photosensitive drum having a selenium photosensitive layer and is provided with a blade cleaning means with a urethane rubber blade. The image density was found to be about 1.3–1.4 under the conditions of normal temperature and normal humidity (23° C., 60% RH). The copying machine having the developer was left to stand overnight under the conditions of high temperature and high humidity (32.5° C., 90%), and thereafter image forming test was conducted. As the result, the image density at initial image formation after left to stand was 1.2, and the image density remained as about 1.1 even left to stand for one week. Also, in successive copying tests, under the respective environments of high temperature-high humidity and low temperature-low humidity, successive copying of 10,000 sheets was performed respectively, whereby good images could be obtained.

EXAMPLE 5

The same tests as in Example 4 were conducted except for changing the treated silica fine powder to 100 parts by weight of the silica fine powder with specific surface area of 200 $m^2/g$ treated with 20 parts by weight of hexamethyldisilazane and 3 parts by weight of silicone oil (KF-96). The silica fine powder was found to have a methanol hydrophobicity of 66 and a negative chargeability of −180μc/g. A developer was prepared and applied for the copying machine similarly as in Example 1. At normal temperature and normal humidity, an image density of 1.33 was obtained, and when left to stand under high temperature and high humidity, the image density was 1.0–1.1, thus exhibiting good developing with a specific surface area of 200 $m^2/g$ simultaneously with 20 parts by weight of hexamethyldisilazane and 10 parts by weight of characteristics of the developer. There was also no problem in successive copying under the respective environments.

COMPARATIVE EXAMPLE 3

Treated silica fine powder was obtained by reacting 20 parts by weight of hexamethyldisilazane with 100 parts by weight of silica fine powder with a specific surface area of 200 $m^2/g$. When the triboelectric charging characteristic of the silica fine powder was examined, it had a negative chargeability of −150μc/g. A developer was prepared and tested in the same manner as in Example 4 except for using the treated silica powder obtained. The treated silica fine powder was found to have a hydrophobicity of 98%. Further, the silica fine powder obtained was found to have a methanol hydrophobicity of 62. The developer prepared gave a good image with an image density of 1.3 at normal temperature and normal humidity, but the image density was lowered to 1.0 after left to stand under high temperature and high humidity conditions after one day, and the image density lowered to 0.7 after standing for one week.

COMPARATIVE EXAMPLE 4

Treated silica fine powder was obtained by treating 100 parts by weight of silica fine powder with a specific surface area of 200 $m^2/g$ simultaneously with 20 parts by weight of hexamethyldisilazane and 10 parts by weight of silicone oil. The treated silica fine powder formed by this treatment was found to have a methanol hydrophobicity of 40 and a negative chargeability of −150 μc/g. A developer was prepared and applied for the coping machine in the same manner as in Example 4. An image density of 1.3 was obtained at normal temperature and normal humidity, but the image density was lowered to 0.9 after left to stand one day at high temperature and high humidity, and lowered to 0.6 after standing for one week.

EXAMPLE 6

After 100 parts by weight of silica fine powder with a specific surface area of 300 $m^2g$ (Aerosil #300, produced by Nippon Aerosil Co.) were treated with 30 parts by weight of hexamethyldisilazane, and the treated powder was further treated with 20 parts by weight of α-methylstyrene-modified silicone oil (KF-410, produced by Shinetsu Kagaku) to obtain hydrophobic, negatively chargeable silica fine powder. Said silica fine powder was found to have a hydrophobicity of 97%, a methanol hydrophobicity of 73 and a negative chargeability of −210μc/g. Said silica fine powder (0.3 parts by weight) was blended with 100 parts by weight of the magnetic toner classified product of Example 4 to prepare a developer. When image forming test was conducted in the same manner as in Example 4, an image density of 1.2–1.3 was exhibited at normal temperature and normal humidity, and also an image density of 1.0–1.1 was obtained even after standing under high temperature and high humidity for 1 week, with good results being also obtained after successive copying for 10,000 times under the respective environments.

EXAMPLE 7

The dimethyldichlorosilane-treated silica fine powder (100 parts by weight) obtained by treating 100 parts by weight of silica fine powder having a BET specific surface area of 130 $m^2/g$ with 10 parts by weight of dimethyldichlorosilane was treated with 5 parts by weight of dimethylsilicone oil. (KF-96, produced by Shinetsh Kagaku) in the same manner as in Example 4 to obtain hydrophobic, negatively chargeable silica powder (hydrophobicity 96%). The treated silica fine powder was blended with 0.4 parts by weight of the magnetic toner classified product of Example 4 to prepare a developer, which was then subjected to the same image forming test as in Example 4. Under the conditions of normal temperature and normal humidity, image density was 1.3, and also it was 1.1 or higher even after standing for one week under high temperature and high humidity conditions, thus exhibiting good results. Also, good results were obtained in successive copying tests under the respective environments.

EXAMPLE 8

Styrene-butyl acrylate (8:2): 100 parts
Magnetic material (magnetite average size 0.3 μm): 60 parts
Polypropylene wax: 3 parts
Chromium containing organic complex: 2 parts The above mixture was melted and kneaded on hot rolls at 150° to 190° C. for 30 minutes and then cooled, followed by pulverization to about 10μ.

The pulverized product obtained was classified to a volume average particle size of 10 to 12μ by means of a wind force classifier. This is called the negatively chargeable magnetic toner classified product.

After 100 parts by weight of the dry process silica fine powder with a specific surface area of 200 $m^2/g$ were treated in a dry system with 20 parts by weight of hexamethyldisilazane (hereinafter HMDS), the treated powder was treated by spraying with 8 parts by weight of dimethylsilicone oil (KF-96). This is called the treated silica sample-a.

With 100 parts by weight of the above magnetic toner classified product, 0.4 parts by weight of the sample-a were blended to obtain a developer.

By means of a laser beam printer provided with an OPC photosensitive drum having surface hardness of 21 g and a blade cleaning means with a urethane rubber blade (LBP-8AJI, produced by Canon), image formation evaluation was conducted. As the result, during image formation repeated for 5,000 sheets under the normal temperature and normal humidity environment, image density was stably 1.3 or higher, also without any deterioration in image quality.

In image formation for one week at 5,000 sheets/day under the high temperature and high humidity environment, the difference in image density between the initial stage and after successive copying is 0.2 or less, with the minimum value being also 1.2 or higher. Thus, no deterioration in image quality is recognized.

EXAMPLE 9

Treated silica fine powder (sample-b) was obtained by the same treatment as in Example 8 except for changing the treatment amount of the silicone oil relative to silica to 2 parts by weight and evaluated similarly as above.

EXAMPLE 10

Treated silica fine powder (sample-c) was obtained by the same treatment as in Example 8 except for changing the treatment amount of the silicone oil relative to silica to 12 parts by weight and evaluated similarly as above.

EXAMPLE 11

Treated silica fine powder (sample-d) was obtained by the same treatment as in Example 8 except for using silica with a specific surface area of 300 $m^2/g$, 30 parts by weight of a silane coupling agent (HMDS) and 12 parts by weight of α-methylstyrene silicone oil, and evaluated similarly as above.

COMPARATIVE EXAMPLE 5

Treated silica (sample-e) was obtained by the same treatment as in Example 8 except for performing no silicone oil treatment, and evaluated similarly as above.

COMPARATIVE EXAMPLE 6

Treated silica (sample-h) was obtained in the same manner as in Example 8 except for performing simultaneously the treatment with a silane coupling agent (HMDS) and the silicone oil treatment, and evaluated similarly as above.

TABLE 1

| | | Normal temperature-normal humidity | | | | High temperature-high humidity | | | | |
|---|---|---|---|---|---|---|---|---|---|---|
| | | Initial | | After 5,000 sheets | | Initial | | After 5,000 sheets | | |
| | | Image density | Image quality | Image density | Image quality | Image density | Image quality | Image density | Image quality | |
| Example | Sample | | | | | | | | | |
| 8 | a | 1.4 | O | 1.4 | O | 1.35 | O | 1.2 | O | |
| 9 | b | 1.4 | O | 1.3 | O | 1.3 | O | 1.2 | O$^{\Delta}$ | |
| 10 | c | 1.4 | O | 1.4 | O | 1.3 | O | 1.2 | O | |
| 11 | d | 1.4 | O | 1.4 | O | 1.3 | O | 1.2 | O | |
| Comparative Example | | | | | | | | | | |
| 5 | e | 1.3 | O | 1.2 | O | 1.0 | Δ | 0.7 | Δ | Line |
| 6 | h | 1.3 | Δ | 1.1 | Δ | 1.0 | Δ | 0.7 | X | becomes narrower |

(Note)
O . . . Good
O$^{\Delta}$ . . . Slightly good
Δ . . . Slightly bad
X . . . Bad

EXAMPLE 12

Styrene-butyl acrylate: 100 parts
(copolymerization ratio: 8:2)
Magnetic material (magnetite average size 0.3 μm): 60 parts
Polypropylene wax: 3 parts
Chromium containing organic complex: 2 parts The above mixture was melted and kneaded on hot rolls at 150° to 190° C. for 30 minutes and then cooled, followed by pulverization to about 10μ.

The pulverized product obtained was classified to a volume average particle size of 10 to 12μ by means of a wind force classifier. This is called the negatively chargeable magnetic toner classified product.

After 100 parts by weight of the dry process silica fine powder with a specific surface area of 200 $m^2/g$ were treated in a dry system with 20 parts by weight of hexamethyldisilazane (hereinafter HMDS), the treated powder was treated by spraying with 8 parts b weight of dimethylsilicone oil (KF-96). This is called the treated silica sample-a.

With 100 parts by weight of the above magnetic toner classified product, 0.4 parts by weight of the sample-a were blended to obtain a developer. By introducing the developer into a modified machine obtained by modifying a copying machine provided with an OPC photosensitive drum having surface hardness of 21g and a blade cleaning means with a urethane rubber blade (NP-150Z, produced by Canon) to a machine for reversal developing, the toner image on the OPC photosensitive member was transferred at a transfer current of $5\times10^{-7}$ A/cm for evaluation of image formation. In image formation of 10,000 sheets under normal temperature and normal humidity conditions, the image density was stably 1.3 or higher with no deterioration in image quality being recognized.

In image formation for one week at 10,000 sheets/day under the high temperature and high humidity environment, the difference in image density between the initial stage and after successive copying was 0.2 or less, with the minimum value being also 1.2 or higher. Also, no deterioration in image quality is recognized.

EXAMPLE 13

Treated silica fine powder (sample-b) was obtained by the same treatment as in Example 12 except for changing the treatment amount of the silicone oil relative to silica to 2 parts by weight and evaluated similarly as in Example 12.

EXAMPLE 14

Treated silica (sample-e) was obtained by the same treatment as in Example 12 except for changing the treatment amount of the silicone oil relative to silica to 12 parts by weight and evaluated similarly as in Example 12.

EXAMPLE 15

Treated silica fine powder (sample-d) was obtained by the same treatment as in Example 12 except for using silica with a specific surface area of 300 $m^2/g$, 30 parts by weight of a silane coupling agent (HMDS) and 12 parts by weight of α-methylstyrene silicone oil, and evaluated similarly as in Example 12.

COMPARATIVE EXAMPLE 7

Treated silica (sample-e) was obtained by the same treatment as in Example 12 except for performing no silicone oil treatment, and evaluated similarly as in Example 12.

COMPARATIVE EXAMPLE 8

Treated silica (sample-h) was obtained in the same manner as in Example 12 except for performing simultaneously the treatment with a silane coupling agent (HMDS) and the silicone oil treatment, and evaluated similarly as in Example 12.

TABLE 2

| | | Normal temperature-normal humidity | | | | High temperature-high humidity | | | | |
|---|---|---|---|---|---|---|---|---|---|---|
| | | Initial | | After 10,000 sheets | | Initial | | After 10,000 sheets | | |
| | | Image density | Image quality | Image density | Image quality | Image density | Image quality | Image density | Image quality | |
| Example | Sample | | | | | | | | | |
| 12 | a | 1.4 | O | 1.4 | O | 1.35 | O | 1.2 | O | |
| 13 | b | 1.4 | O | 1.3 | O | 1.3 | O | 1.2 | O$^{\Delta}$ | |
| 14 | c | 1.4 | O | 1.4 | O | 1.3 | O | 1.2 | O | |
| 15 | d | 1.4 | O | 1.4 | O | 1.3 | O | 1.2 | O | |
| Comparative Example | | | | | | | | | | |
| 7 | e | 1.3 | O | 1.2 | O | 1.0 | Δ | 0.7 | Δ | Scattered during transfer |
| 8 | h | 1.3 | Δ | 1.1 | Δ | 1.0 | Δ | 0.7 | X | |

As is evident from the above results, in an electrophotographic system having a reversal developing system and with low transfer current, by use of the two-step treated silica fine powder according to the present invention, a developer with good environmental stability and high durability can be obtained.

EXAMPLE 16

Styrene-acrylic resin: 100 parts
(trade name: Hymar SBM 700, produced by Sanyo Kasai Co.)
Magnetic fine powder (magnetite average size 0.2μ) (trade name: EPT-1000, produced by Toda Kogyo Co.) 60 parts
Compound A: 2.0 parts
(structural formula A-1, $\bar{d}v=6.0$ μm, $\bar{d}n=3.2$ μm, volume resistivity $R=10^9$ Ω·cm)
Compound B: 1.0 part
(structural formula B-2, $\bar{d}v=5.6$ μm $\bar{d}n=4.0$ μm, volume resistivity $R=10^{10}$ Ω·cm)

The above materials were melted and kneaded on roll mill and after cooling micropulverized by jet mill, followed further by classification to obtain a negatively chargeable magnetic toner classified product with an average particle size of 9 μm.

Next, after silica fine powder [specific surface area 200 $m^2/g$, Aerosil #200, produced by Nippon Aersil Co.] was applied with the silane coupling treatment with 20 parts by weight of hexamethylenedisilazane (HMDS), 100 parts by weight of the treated produce were again treated with 10 parts by weight of dimethylsilicone oil (KF-96, produced by Shinetsu Kagaku, viscosity 100 cs) diluted with a solvent, and after drying subjected to heating treatment at 250° C. to obtain silica fine powder treated with dimethylsilicone oil. To 100 parts by weight of the magnetic toner classified product as described above, 0.4 parts by weight of the treated silica were externally added to obtain a developer having the magnetic toner. The treated silica fine powder was found to have a hydrophobicity of 98%. For the developer, by use of a laser beam printer of the reversal developing system provided with an OPC photosensitive drum having surface hardness of 21g and a blade cleaning means with a urethane rubber blade (LBP-CX, produced by Canon), image forming test was conducted under the condition of a drum charging quantity −700 V, $V_{DC}$ 500 V, developing bias Vpp 1600 V, frequency 180 Hz, and drum-sleeve distance 270μ, to obtain good images. The image density was 1.31 after copying 500 sheets, 1.39 after copying 1,000 sheets, thus giving high image density.

Further, when successive copying test was conducted under low temperature-low humidity and high temperature-high humidity conditions, no image badness such as filming, toner fusion, drum damage, image flowing, image white drop-out, etc. occurred even after successive copying of 5,000 sheets.

When the photosensitive drum surface was observed, no image fog was seen.

EXAMPLE 17

Styrene resin (trade name: Piccolastic D-125, produced by Hercules Co.): 100 parts Magnetic powder (magnetite fine powder, average size 0.2μ): 60 parts Compound A: 1.0 part (structural formula A-2, $\bar{d}v=6.0$ μm, $\bar{d}n=3.4$ μm, volume resistivity $R=10^9$ Ω·cm)

Compound B: 3.0 parts (structural formula B-1, $\bar{d}v=6.5$ μm, $\bar{d}n=4.0$ μm, volume resistivity $R=10^{10}$ Ω·cm)

The above materials were melted and kneaded on roll mills, and then the respective steps of fine pluverization and classification were practiced to obtain a negatively chargeable magnetic toner with an average particle size of 9 μm.

Similarly as in Example 16, to 100 parts by weight of the classified product were externaly added 0.4 parts by weight of the silica fine powder applied with the silicone oil treatment after treated with the silane coupling treatment, to obtain a developer. The developer was subjected to the same image forming test as in Example 16 to obtan good results. The image density was 1.29 after copying of 500 sheets, and 1.31 after copying of 1,000 sheets, thus giving high image density.

When the photosensitive drum surface before transfer was observed, no image fog was seen in the toner image.

COMPARATIVE EXAMPLE 9

Treated silica fine powder was obtained in the same manner as in Example 4 except for treating 100 parts by weight of the untreated silica fine powder only with 10 parts by weight of dimethyl silicone oil. The treated silica fine powder obtained was found to have a hydrophobicity of 80 and a methanol hydrophobicity of 25. A developer was prepared by blending 0.4 parts by weight of the treated silica obtained and 100 parts by weight of the magnetic toner classified product prepared in the same manner as in Example 4. When image forming test was conducted in the same manner as in Example 4, the image density was lowered to 0.7 after standing for one week under the high temperature and high humidity conditions, with filming being also exhibited, and also humidity resistance was worse than the developer in Example 4.

What is claimed is:

1. A developer for developing electrostatic latent images, comprising negatively chargeable toner particles comprising a binder resin, a magnetic material and a negatively chargeable controller, and hydrophobic, negatively chargeable silica fine powder, said silica fine powder being obtained by treating silica fine powder with a silane coupling agent represented by the following formula:

RmSiYn or $Y_3$—Si—NH—Si—$Y_3$ wherein R represents alkoxy group or chlorine atom, Y represents alkyl group, m represents positive integer of 1 to 3 and n represents positive integer of 3 to 1, with proviso that m+n is 4, and treating further said treated silica fine powder with a silicone oil having the structure:

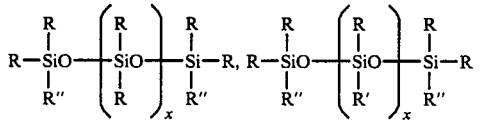

or

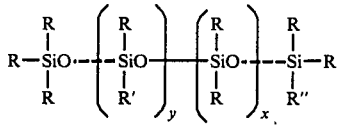

wherein R represents alkyl group having 1 to 3 carbon atoms, R′ represents alkyl group different from R having 1 to 10 carbon atoms, halogen-modified alkyl group having 1 to 10 carbon atoms, phenyl-modified alkyl group or phenyl group, R″ represents alkyl group having 1 to 3 carbon atoms or alkoxy group having 1 to 3 carbon atoms (with proviso that R″ represents a group which may be either the same as or different from R), and x and y each represent positive integer, wherein said silica fine powder is treated with 5 to 40 parts by weight of the silane coupling agent per 100 parts by weight of the untreated silica fine powder having a BET specific surface area of 40 to 400 m2/g, and further treated with A/25±A/30 parts by weight, wherein A represents the BET specific surface area value of the untreated silica fine powder, of said silicone oil.

2. A developer according to claim 1, wherein the toner particles comprise 100 parts by weight of a binder resin and 10 to 200 parts by weight of a magnetic material.

3. A developer according to claim 2, wherein the toner particles contain 50 to 150 parts by weight of the magnetic material.

4. A developer according to claim 1, wherein the toner paticles contain 0.1 to 10 parts by weight of a negatively chargeable charge controller per 100 parts by weight of the binder resin.

5. A developer according to claim 1, wherein the toner particles contain a metal complex compound of an aromatic hydroxylcarboxylic acid having lipophilic group (A) and a metal complex salt type monoazo dye having free hydrophilic group (B) as the negatively chargeable charge controller.

6. A developer according to claim 5, wherein the toner particles contain 0.1 to 10 parts by weight of said compound (A) and said compound (B) per 100 parts by weight of the binder resin.

7. A developer according to claim 6, wherein the compound (A) and the compound (B) are contained at a weight ratio of 1:10 to 10:1.

8. A developer according to claim 1, wherein the silica fine powder has an average particle size of 0.001 to 2μ.

9. A developer according to claim 1, wherein the silica fine powder has hydrophobicity of 90% or higher.

10. A developer according to claim 9, wherein the silica fine powder has methanol hydrophobicity of 65 or higher according to the methanol titration test.

11. A developer according to claim 10, wherein the silica fine powder is subjected to heat treatment at a temperature of 50° to 150° C. after the treatment with the silane coupling agent and further subjected to heat treatment at a temperature of 150° to 350° C. after the treatment nwith the silicone oil.

12. A developer according to claim 10, wherein the silica fine powder is subjected to heat treatment at a temperature of 200° to 300° C. after the treatment with the silicone oil.

13. A developer according to claim 1, wherein said silicone oil has a viscosity of 50 to 1000 centistokes at a temperature of 25° C.

14. A developer according to claim 1, wherein 50% or more of the silanol groups existing on the surfaces of silica particles have reacted with the silane coupling agent at the stage when the untreated silica fine powder is treated with the silane coupling agent.

15. A developer according to claim 1, wherein 0.01 to 20 parts by weight of the silica fine powder is added per 100 parts of the toner particles.

16. A developer according to claim 15, wherein 0.1 to 3 parts by weight of the silica fine powder is added per 100 parts by weight of the toner particles.

* * * * *